US008165785B2

(12) United States Patent
Mashiki et al.

(10) Patent No.: US 8,165,785 B2
(45) Date of Patent: Apr. 24, 2012

(54) VARIABLE VALVE TIMING APPARATUS AND CONTROL METHOD THEREFOR

(75) Inventors: Zenichiro Mashiki, Nisshin (JP); Yasumichi Inoue, Toyota (JP); Yoshihito Moriya, Nagoya (JP); Haruyuki Urushihata, Chiryu (JP)

(73) Assignees: Toyota Jidosha Kabushiki Kaisha, Aichi-Ken (JP); Denso Corporation, Aichi-Ken (JP)

( * ) Notice: Subject to any disclaimer, the term of this patent is extended or adjusted under 35 U.S.C. 154(b) by 915 days.

(21) Appl. No.: 12/279,778

(22) PCT Filed: Feb. 7, 2007

(86) PCT No.: PCT/JP2007/052653

§ 371 (c)(1),
(2), (4) Date: Aug. 18, 2008

(87) PCT Pub. No.: WO2007/099770

PCT Pub. Date: Sep. 7, 2007

(65) Prior Publication Data

US 2010/0222990 A1 Sep. 2, 2010

(30) Foreign Application Priority Data

Feb. 22, 2006 (JP) ..... 2006-045783
Aug. 10, 2006 (JP) ..... 2006-218713

(51) Int. Cl.
*F02D 41/00* (2006.01)
*F01L 1/34* (2006.01)

(52) U.S. Cl. ..... 701/105; 123/90.15

(58) Field of Classification Search .... 123/90.15–90.17, 123/90.31; 701/101, 102, 103, 105
See application file for complete search history.

(56) References Cited

U.S. PATENT DOCUMENTS

| | | | | |
|---|---|---|---|---|
| 5,562,071 | A * | 10/1996 | Urushihata et al. | 123/90.15 |
| 6,330,869 | B1 * | 12/2001 | Yoshiki et al. | 123/90.15 |
| 6,920,855 | B2 * | 7/2005 | Takenaka et al. | 123/90.17 |
| 7,107,951 | B2 * | 9/2006 | Urushihata et al. | 123/90.17 |
| 7,406,933 | B2 * | 8/2008 | Inoue et al. | 123/90.17 |
| 2003/0177992 | A1 | 9/2003 | Takenaka et al. | |
| 2004/0084000 | A1 | 5/2004 | Takenaka et al. | |
| 2005/0022765 | A1 | 2/2005 | Takenaka et al. | |
| 2005/0061277 | A1 | 3/2005 | Takenaka et al. | |
| 2009/0055085 | A1 * | 2/2009 | Inoue et al. | 701/105 |
| 2010/0162980 | A1 * | 7/2010 | Mashiki et al. | 123/90.17 |
| 2010/0222990 | A1 * | 9/2010 | Mashiki et al. | 701/105 |

FOREIGN PATENT DOCUMENTS

DE 10 2004 007 052 A1 9/2005

(Continued)

*Primary Examiner* — Stephen K Cronin
*Assistant Examiner* — Arnold Castro
(74) *Attorney, Agent, or Firm* — Sughrue Mion, PLLC

(57) ABSTRACT

An ECU executes a program including the step of stopping power supply to an electric motor if a phase of an intake valve is in a first region between the most retarded angle and CA. In the case where the phase of the intake valve is in the first region, the rotational speed of relative rotation between the output shaft of the electric motor and a sprocket is reduced at reduction gear ratio R thereby to vary the phase of the intake valve. In the case where the phase of the intake valve is in a second region between CA and the most advanced angle, the rotational speed of the relative rotation is reduced at reduction gear ratio R thereby to vary the phase of the intake valve.

16 Claims, 13 Drawing Sheets

FOREIGN PATENT DOCUMENTS

| | | | |
|---|---|---|---|
| JP | 2004-150397 | A | 5/2004 |
| JP | 2004-190663 | A | 7/2004 |
| JP | 2005-48706 | A | 2/2005 |
| JP | 2005-48707 | A | 2/2005 |
| JP | 2005-98142 | A | 4/2005 |

* cited by examiner

VARIABLE VALVE TIMING APPARATUS AND CONTROL METHOD THEREFOR

TECHNICAL FIELD

The present invention relates to a variable valve timing apparatus and a control method therefor. In particular, the invention relates to a variable valve timing apparatus that varies the timing at which a valve is opened/closed by a variation amount according to an operation amount of an actuator, and a control method therefor.

BACKGROUND ART

VVT (Variable Valve Timing) has conventionally been known that changes the phase (crank angle) in (at) which an intake valve or an exhaust valve is opened/closed, according to an operating condition. Generally, the VVT changes the phase by rotating, relative to a sprocket or the like, a camshaft that causes the intake valve or exhaust valve to open/close. The camshaft is rotated by such an actuator as hydraulic or electric motor. Particularly, in the case where the electric motor is used to rotate the camshaft, the torque for rotating the camshaft is difficult to obtain, as compared with the case where the camshaft is hydraulically rotated. Therefore, in the case where the electric motor is used to rotate the camshaft, the rotational speed of the output shaft of the electric motor is reduced by a speed reducer mechanism or the like, thereby rotating the camshaft. In this case, the degree of phase shift is restricted by the speed reducer mechanism.

Japanese Patent Laying-Open No. 2004-150397 discloses a valve timing adjustment device with a great degree of freedom of phase shift. The valve timing adjustment device disclosed in Japanese Patent Laying-Open No. 2004-150397 is provided to a transmission system for transmitting drive torque from a drive shaft of an internal combustion engine to a driven shaft for opening and closing at least one of an air intake valve and an exhaust valve, for adjusting the timing at which at least one of the air intake valve and the exhaust valve opens and closes. The valve timing adjustment device includes: a first rotator rotating around a rotation centerline by the drive torque from the drive shaft; a second rotator rotating around the rotation centerline together with the rotation of the first rotor and in the same direction as the first rotor so as to make the driven shaft rotate synchronously, wherein the second rotor is capable of rotating relative to the first rotor; and a control device having a control member and varying the radial distance of the control member from the rotation centerline. The first rotor defines a first hole forming a first track that extends so as to vary its radial distance from the rotation centerline. The first hole makes contact with the control member that passes through the first track, with the contact between the first hole and the control member occurring at two sides of the first hole toward which the first rotor rotates. The second rotor defines a second hole forming a second track extending so as to vary its radial distance from the rotation centerline and making contact with the control member that passes through the second track, with the contact between the second hole and the control member occurring at two sides of the second hole toward which the second rotor rotates. The first track and the second track slant toward each other along the rotational direction of the first rotor and the rotational direction of the second rotor. In this valve timing device, in the case where the electric motor generates no torque, the phase is maintained.

According to the valve timing adjustment device disclosed in this publication, the first hole of the first rotor forms a first track that extends so as to vary its radial distance from the rotation centerline and makes contact with the control member that passes through the first track, with the contact between the first hole and the control member occurring at two sides of the first hole toward which the first rotor rotates. Furthermore, the second hole of the second rotor forms a second track extending so as to vary its radial distance from the rotation centerline and makes contact with the control member that passes through the second track, with the contact between the second hole and the control member occurring at two sides of the second hole toward which the second rotor rotates. Here, the first track and the second track slant toward each other along the rotational direction of the first rotor and the rotational direction of the second rotor. Therefore, when the control device acts to change the control member's radial distance from the rotation centerline, the control member presses against at least one of the first hole and the second hole, whereby the control member passes through both the first track and the second track, and thus the second rotor is caused to rotate relative to the first rotor. In the valve timing adjustment device which operates in the forgoing manner, the degree of phase shift of the second rotor with respect to the first rotor is dependent upon the length of the first track and the second track and the degree to which the first track and the second track slant toward each other. By extending the first track and the second track such that they vary their radial distances from the rotation centerline, relative freedom is achieved in determining the length and the mutual slant of the tracks. In turn, this increases freedom in setting the degree of phase shift of the second rotor with respect to the first rotor, and therefore, the degree of phase shift of the driven shaft with respect to the drive shaft.

However, as in the valve timing adjustment device disclosed in Japanese Patent Laying-Open No. 2004-150397, when the electric motor generates no torque, that is, when power supply to the electric motor is stopped, in order to maintain the phase, the reduction gear ratio which is the ratio of the phase shift amount with respect to the operation amount of the electric motor has to be increased so that the output shaft of the electric motor is not rotated by the torque transmitted from the camshaft to the electric motor. However, if the reduction gear ratio is high, the region in which the opening/closing timing can be changed becomes narrower.

DISCLOSURE OF THE INVENTION

An object of the present invention is to provide a variable valve timing apparatus and the like, which can maintain the phase by stopping power supply to an actuator and can vary an opening/closing timing over a wide range.

A variable valve timing apparatus in accordance with an aspect of the present invention changes an opening/closing timing of at least any one of an intake valve and an exhaust valve. The variable valve timing apparatus includes: an actuator operating the variable valve timing apparatus; a change mechanism changing the opening/closing timing at a first variation amount with respect to an operation amount of the actuator in a case where the opening/closing timing is in a first region, and changing the opening/closing timing at a second variation amount larger than the first variation amount with respect to an operation amount of the actuator in a case where the opening/closing timing is in a second region different from the first region; and an operation unit. The operation unit controls the opening/closing timing by controlling power supply to the actuator, and controls the opening/closing timing such that the opening/closing timing is maintained by stopping power supply to the actuator, in a case where the opening/closing timing is in the first region.

According to the present invention, in the case where the opening/closing timing is in the first region, the opening/closing timing is changed at the first variation amount with respect to the operation amount of the actuator. In the case where the opening/closing timing is in the second region, the opening/closing timing is changed at the second variation amount larger than the first variation amount with respect to the operation amount of the actuator. Accordingly, the opening/closing timing can be varied widely in the second region. On the other hand, in the first region, the variation amount of the opening/closing timing is small. In other words, the reduction gear ratio is high. Therefore, for example the variation of the opening/closing timing can be restrained which is caused by driving of the actuator by the torque acting on the camshaft as the engine is operated, even in the state where the actuator generates no torque. Thus, in the first region, power supply to the actuator is stopped thereby to maintain the opening/closing timing. Therefore, it is possible to provide a variable valve timing apparatus capable of maintaining the opening/closing timing by stopping power supply to the actuator and of varying the opening/closing timing over a wide range.

Preferably, the change mechanism changes the opening/closing timing according to an operation amount of the actuator such that a ratio between an operation amount of the actuator and a variation amount of the opening/closing timing is varied, in a case where the opening/closing timing is in a third region different from the first region and the second region, in addition to changing the opening/closing timing at the first variation amount with respect to an operation amount of the actuator, in a case where the opening/closing timing is in the first region, and changing the opening/closing timing at the second variation amount with respect to an operation amount of the actuator, in a case where the opening/closing timing is in the second region. The operation unit sets a target timing of the opening/closing timing in a region other than the third region, among the first region, the second region and the third region, and controls the opening/closing timing such that the opening/closing timing becomes the target timing.

According to the present invention, in the case where the opening/closing timing is in the third region, the opening/closing timing is changed such that the ratio between the operation amount of the actuator and the variation amount of the opening/closing timing, namely the reduction gear ratio is varied. For example, in the region between the first region and the second region, the reduction gear ratio is varied. Accordingly, in the case where the opening/closing timing is varied from the first region to the second region or from the second region to the first region, the variation amount of the opening/closing timing with respect to the operation amount of the actuator can be increased or decreased gradually. Therefore, a sudden stepwise change of the variation amount of the opening/closing timing can be restrained to thereby restrain a sudden change in opening/closing timing. However, in such a third region, it is difficult to predict the variation amount of the opening/closing timing with respect to the operation amount of actuator, and therefore the controllability may be deteriorated thereby to deteriorate the accuracy of the opening/closing timing. Therefore, the target timing of the opening/closing timing is set in a region other than the third region, among the first region, the second region and the third region, and then the opening/closing timing is controlled such that this target timing is achieved. Accordingly, the opening/closing timing can be set as the timing in at least any one of the first region and the second region. Therefore, the deteriorated controllability of the opening/closing timing can be restrained and the deteriorated accuracy in opening/closing timing can be restrained.

More preferably, the first region is a region that is retarded with respect to the second region.

According to the present invention, in the region that is retarded, the power supply to the actuator is stopped thereby to maintain the opening/closing timing. Accordingly, for example in an engine in which the opening/closing timing is more frequently set in the retarded region, the frequency of stopping power supply to the actuator can be increased. Therefore, fuel economy can ultimately be enhanced.

Preferably, the variable valve timing apparatus changes the opening/closing timing by rotating a camshaft coupled to an output shaft of an internal combustion engine. In a case where the opening/closing timing is in the first region, if a rotational speed of the internal combustion engine is lower than a predetermined rotational speed, the operation unit controls the opening/closing timing such that the opening/closing timing is maintained by stopping power supply to the actuator, and if a rotational speed of the internal combustion engine is higher than the predetermined rotational speed, the operation unit controls the opening/closing timing such that the opening/closing timing is maintained by providing power supply to the actuator.

According to the present invention, if the rotational speed of the internal combustion engine, namely the rotational speed of the output shaft of the internal combustion engine is lower than a predetermined rotational speed, power supply to the actuator is stopped thereby to maintain the opening/closing timing. If the rotational speed of the internal combustion engine is higher than the predetermined rotational speed, power supply to the actuator is provided thereby to maintain the opening/closing timing. Accordingly, power supply to the actuator can be stopped in the case where the opening/closing timing can be maintained even without supplying power to the actuator because of small torque acting on the camshaft which is caused by driving of the internal combustion engine. The opening/closing timing can be maintained accurately by supplying power to the actuator in the case where the opening/closing timing may be varied because of large torque acting on the camshaft which is caused by driving of the internal combustion engine.

Preferably, the variable valve timing apparatus changes the opening/closing timing by rotating a camshaft coupled to an output shaft of an internal combustion engine. In a case where the opening/closing timing is a most retarded timing in the first region, if a rotational speed of the internal combustion engine is lower than a predetermined rotational speed, the operation unit controls the opening/closing timing such that the opening/closing timing is maintained by stopping power supply to the actuator, and if a rotational speed of the internal combustion engine is higher than the predetermined rotational speed, the operation unit controls the opening/closing timing such that the opening/closing timing is maintained by providing power supply to the actuator.

According to the present invention, if the rotational speed of the internal combustion engine, namely the rotational speed of the output shaft of the internal combustion engine is lower than a predetermined rotational speed, power supply to the actuator is stopped thereby to maintain the opening/closing timing at the most retarded timing in the first region. If the rotational speed of the internal combustion engine is higher than the predetermined rotational speed, power supply to the actuator is provided thereby to maintain the opening/closing timing at the most retarded timing in the first region. Accordingly, power supply to the actuator can be stopped in the case where the opening/closing timing can be maintained at the most retarded timing even without supplying power to the actuator because of small torque acting on the camshaft which is caused by driving of the internal combustion engine. The opening/closing timing can be maintained accurately at the delayed timing by supplying power to the actuator in the case where the opening/closing timing may be varied because of large torque acting on the camshaft which is caused by driving of the internal combustion engine.

BEST MODES FOR CARRYING OUT THE INVENTION

Figure 1:
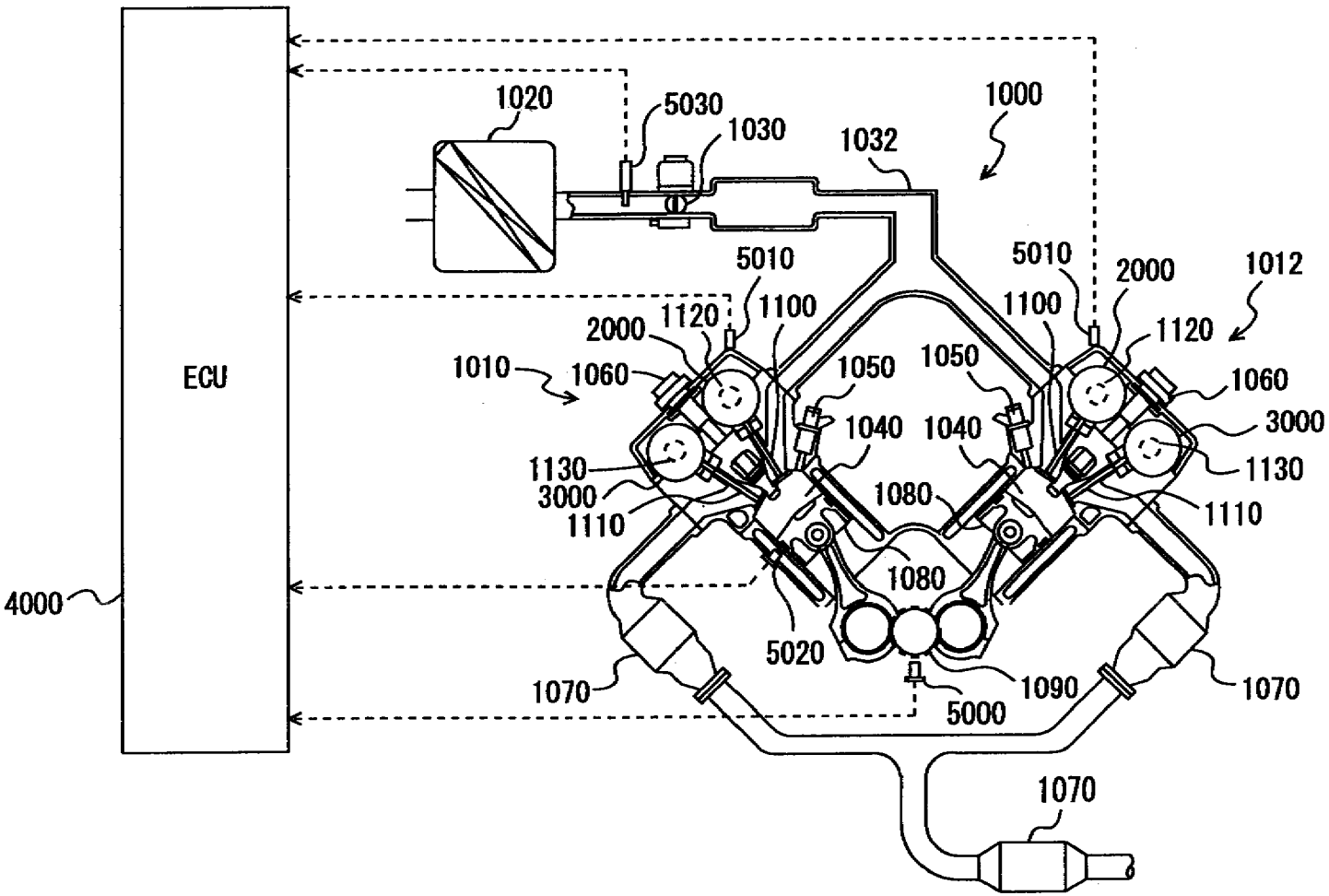
FIG. 1 is a schematic showing a configuration of an engine of a vehicle on which a variable valve timing apparatus is mounted according to a first embodiment of the present invention.

With reference to the drawings, embodiments of the present invention are hereinafter described. In the following description, like components are denoted by like reference characters. They are also named identically and function identically. Therefore, a detailed description thereof is not repeated.

First Embodiment

Referring to FIG. 1, a description is given of an engine of a vehicle on which a variable valve timing apparatus is mounted, according to a first embodiment of the present invention.

An engine 1000 is a V-type 8-cylinder engine having an "A" bank 1010 and a "B" bank 1012 each including a group of four cylinders. Here, any engine other than the V8 engine may be used.

Into engine 1000, air is sucked from an air cleaner 1020. The quantity of sucked air is adjusted by a throttle valve 1030. Throttle valve 1030 is an electronic throttle valve driven by a motor.

The air is supplied through an intake manifold 1032 into a cylinder 1040. The air is mixed with fuel in cylinder 1040 (combustion chamber). Into cylinder 1040, the fuel is directly injected from an injector 1050. In other words, injection holes of injector 1050 are provided within cylinder 1040.

The fuel is injected in the intake stroke. The fuel injection timing is not limited to the intake stroke. Further, in the present embodiment, engine 1000 is described as a direct-injection engine having injection holes of injector 1050 that are disposed within cylinder 1040. However, in addition to direct-injection injector 1050, a port injector may be provided. Moreover, only the port injector may be provided.

The air-fuel mixture in cylinder 1040 is ignited by a spark plug 1060 and accordingly burned. The air-fuel mixture after burned, namely exhaust gas, is cleaned by a three-way catalyst 1070 and thereafter discharged to the outside of the vehicle. The air-fuel mixture is burned to press down a piston 1080 and thereby rotate a crankshaft 1090.

At the top of cylinder 1040, an intake valve 1100 and an exhaust valve 1110 are provided. Intake valve 1100 is driven by an intake camshaft 1120. Exhaust valve 1110 is driven by an exhaust camshaft 1130. Intake camshaft 1120 and exhaust camshaft 1130 are coupled by such parts as a chain and gears to be rotated at the same rotational speed.

Intake valve 1100 and exhaust valve 1110 are coupled to crankshaft 1090 through a timing belt or chain. Intake valve 1100 and exhaust valve 1110 are rotated along with the rotation of crankshaft 1090.

Intake valve 1100 has its phase (opening/closing timing) controlled by an intake VVT mechanism 2000 provided to intake camshaft 1120. Exhaust valve 1110 has its phase (opening/closing timing) controlled by an exhaust VVT mechanism 3000 provided to exhaust camshaft 1130.

In the present embodiment, intake camshaft 1120 and exhaust camshaft 1130 are rotated by the VVT mechanisms to control respective phases of intake valve 1100 and exhaust valve 1110. Here, the phase control method is not limited to the aforementioned one.

Figure 3:
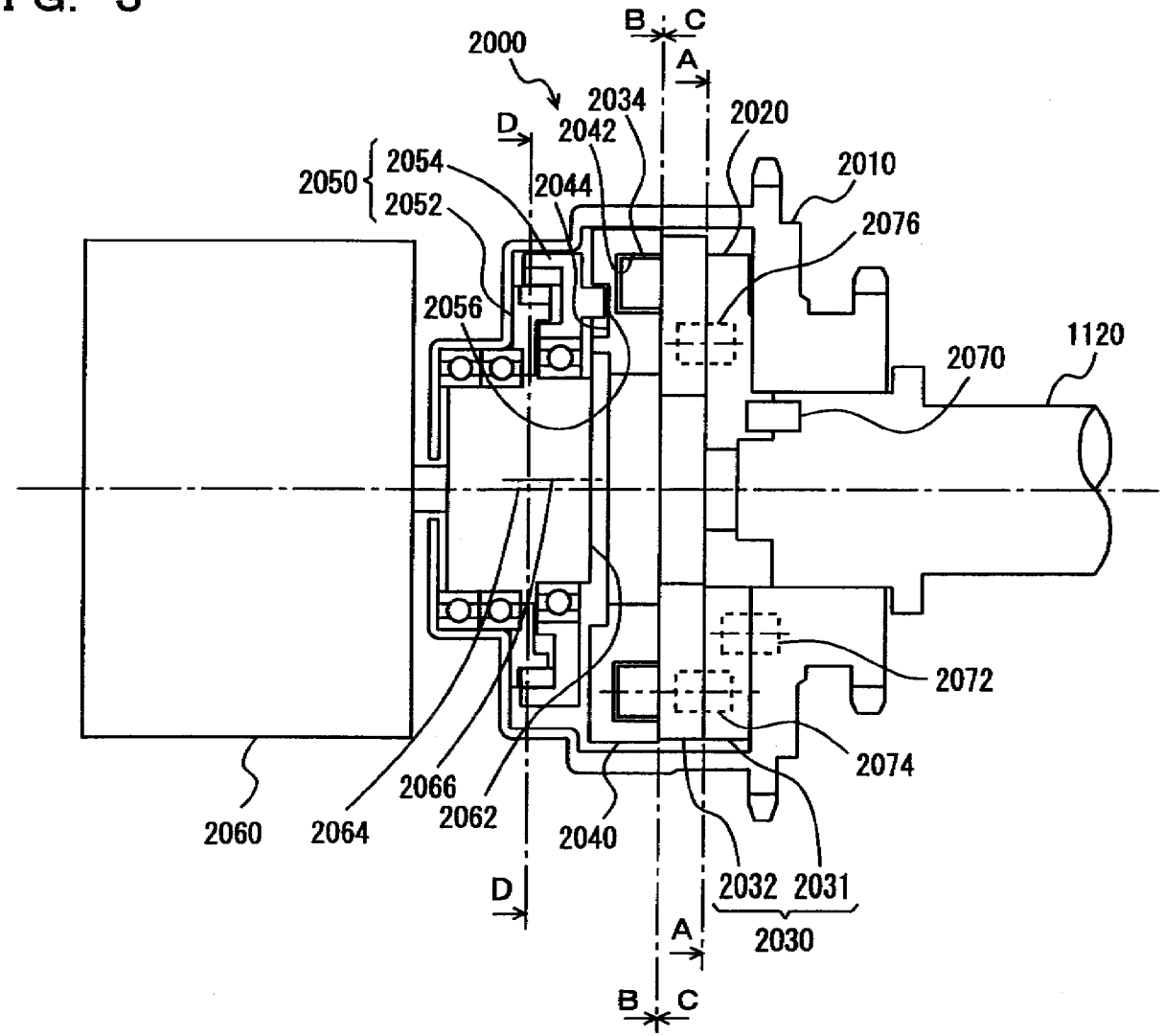
FIG. 3 is a cross section showing an intake VVT mechanism.

Intake VVT mechanism 2000 is operated by an electric motor 2060 (not shown in FIG. 3). Electric motor 2060 is controlled by an ECU (Electronic Control Unit) 4000. The current and voltage of electric motor 2060 are detected by an ammeter (not shown) and a voltmeter (not shown) and the measurements are input to ECU 4000.

Exhaust VVT mechanism 3000 is hydraulically operated. Here, intake VVT mechanism 2000 may be hydraulically operated while exhaust VVT mechanism 3000 may be operated by an electric motor.

To ECU 4000, signals indicating the rotational speed (namely, the engine speed NE) and the crank angle of crankshaft 1090 are input from a crank angle sensor 5000. Further, to ECU 4000, signals indicating respective phases of intake camshaft 1120 and exhaust camshaft 1130 (the signal indicating the respective phases of intake valve 1100 and exhaust valve 1110) (phase: the camshaft position in the rotational direction) are input from a cam position sensor 5010.

Furthermore, to ECU 4000, a signal indicating the water temperature (coolant temperature) of engine 1000 from a coolant temperature sensor 5020 as well as a signal indicating the quantity of intake air (quantity of air taken or sucked into engine 1000) of engine 1000 from an airflow meter 5030 are input.

Based on these signals input from the sensors as well as a map and a program stored in a memory (not shown), ECU 4000 controls the throttle opening position, the ignition timing, the fuel injection timing, the quantity of injected fuel, the phase of intake valve 1100 and the phase of exhaust valve 1110 for example, so that engine 1000 is operated in a desired operating state.

Figure 2:
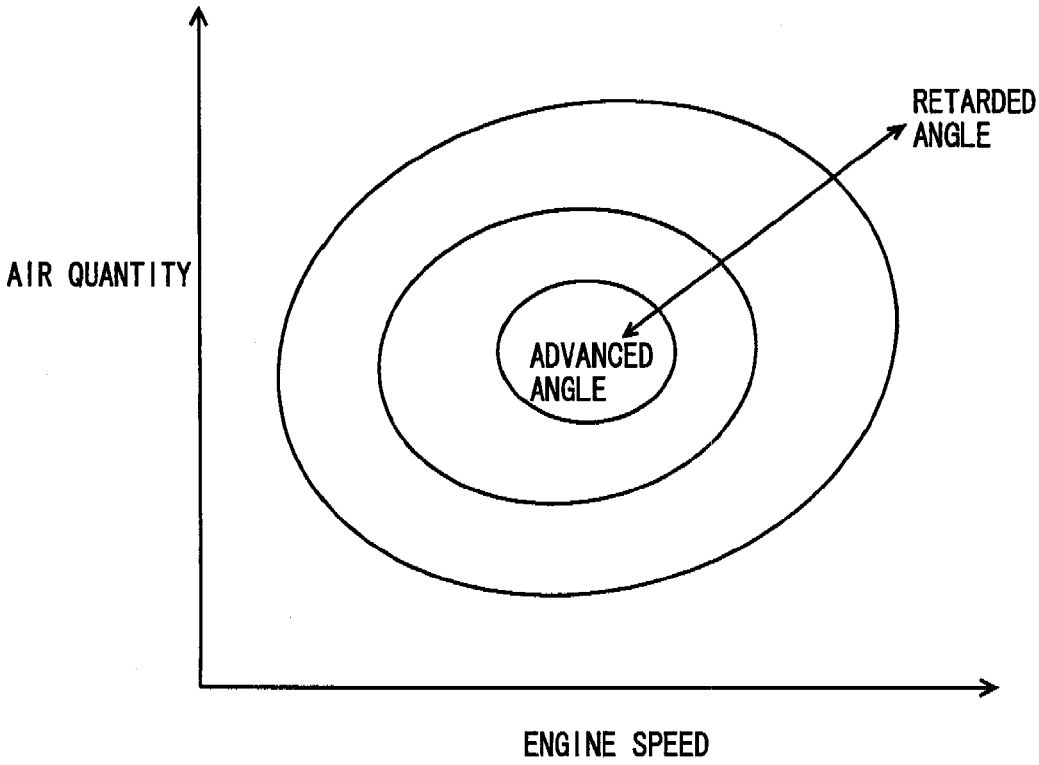
FIG. 2 shows a map defining the phase of an intake valve.

In the present embodiment, ECU 4000 determines the phase of intake valve 1100 based on the map as shown in FIG. 2 that uses the engine speed NE and the intake air quantity KL as parameters. A plurality of maps for respective coolant temperatures are stored for determining the phase of intake valve 1100.

In the following, a further description is given of intake VVT mechanism 2000. Here, exhaust VVT mechanism 3000 may be configured identically to intake VVT mechanism 2000 as described below.

As shown in FIG. 3, intake VVT mechanism 2000 is comprised of a sprocket 2010, a cam plate 2020, a link mechanism 2030, a guide plate 2040, a speed reducer 2050, and electric motor 2060.

Sprocket 2010 is coupled via a chain or the like to crankshaft 1090. The rotational speed of sprocket 2010 is half the rotational speed of crankshaft 1090. Intake camshaft 1120 is provided concentrically with the rotational axis of sprocket 2010 and rotatably relative to sprocket 2010.

Cam plate 2020 is coupled to intake camshaft 1120 with a pin (1) 2070. Cam plate 2020 rotates, on the inside of sprocket 2010, together with intake camshaft 1120. Here, cam plate 2020 and intake camshaft 1120 may be integrated into one unit.

Figure 4:
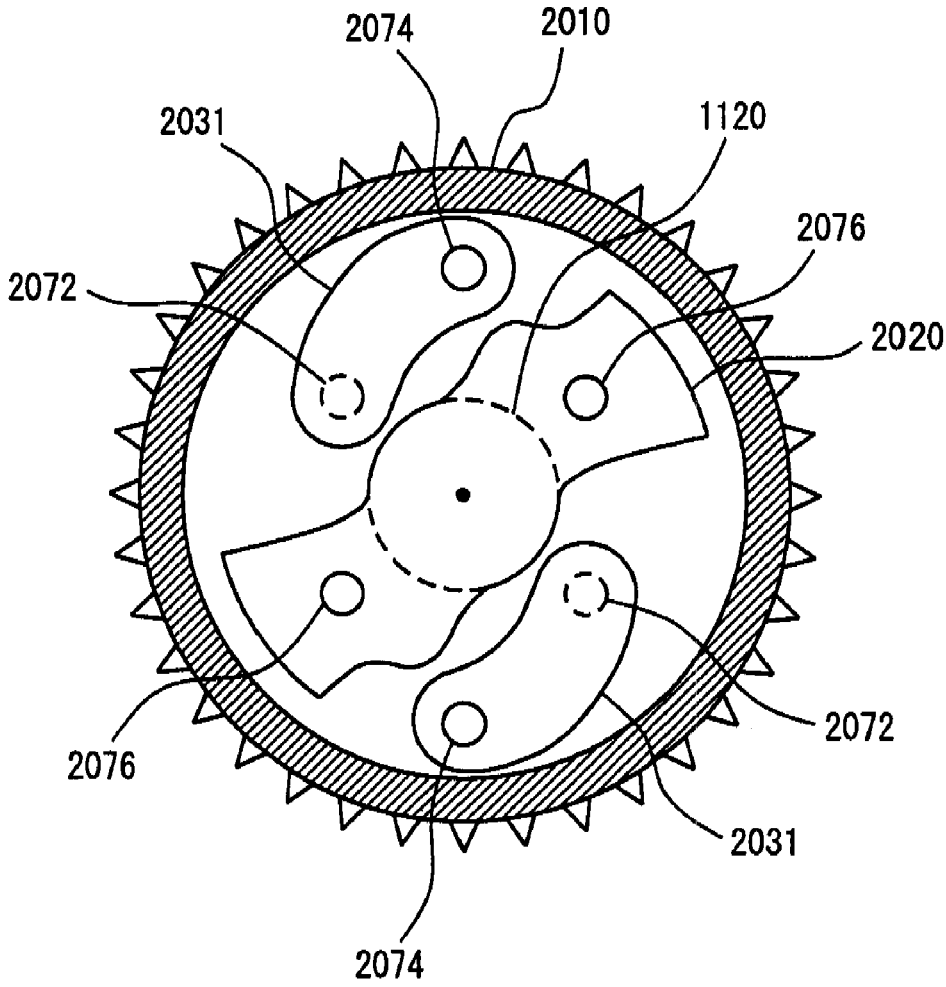
FIG. 4 is a cross section along A-A in FIG. 3.

Link mechanism 2030 is comprised of an arm (1) 2031 and an arm (2) 2032. As shown in FIG. 4 which is a cross section along A-A in FIG. 3, a pair of arms (1) 2031 is provided within sprocket 2010 so that the arms are point symmetric to each other with respect to the rotational axis of intake camshaft 1120. Each arm (1) 2031 is coupled to sprocket 2010 so that the arm can swing about a pin (2) 2072.

Figure 5:
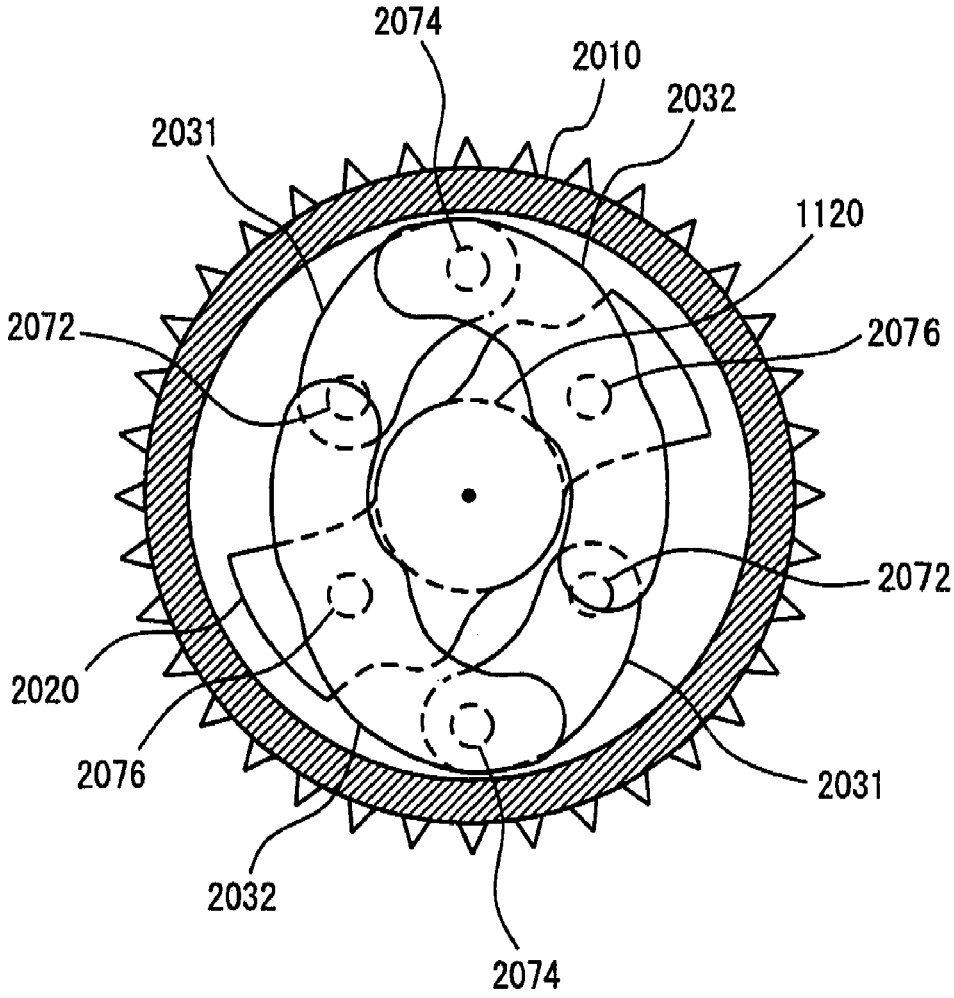
FIG. 5 is a (first) cross section along B-B in FIG. 3.
Figure 6:
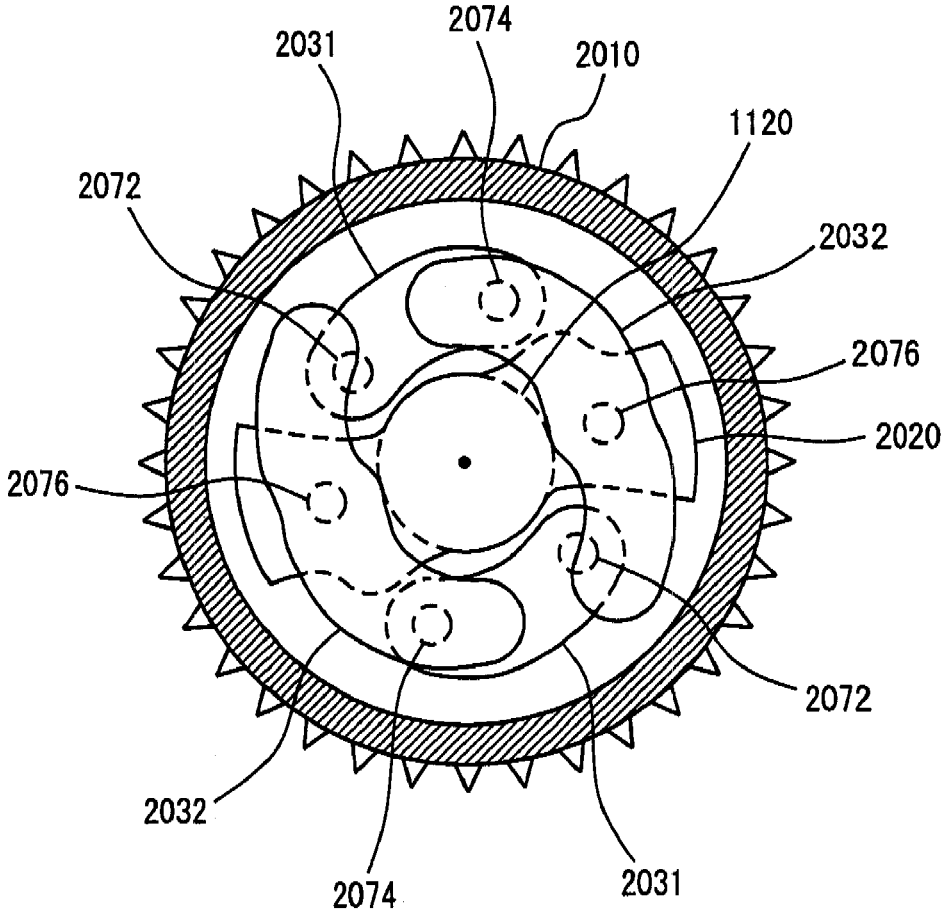
FIG. 6 is a (second) cross section along B-B in FIG. 3.

As shown in FIG. 5 which is a cross section along B-B in FIG. 3 and as shown in FIG. 6 showing the state where the phase of intake valve 1100 is advanced with respect to the state in FIG. 5, arms (1) 2031 and cam plate 2020 are coupled by arms (2) 2032.

Arm (2) 2032 is supported so that the arm can swing about a pin (3) 2074 and with respect to arm (1) 2031. Further, arm (2) 2032 is supported so that the arm can swing about a pin (4) 2076 and with respect to cam plate 2020.

A pair of link mechanisms 2030 causes intake camshaft 1120 to rotate relative to sprocket 2010 and thereby changes the phase of intake valve 1100. Thus, even if one of the paired link mechanisms 2030 is broken as a result of any damage or the like, the other link mechanism can be used to change the phase of intake valve 1100.

Referring back to FIG. 3, at a surface of each link mechanism 2030 (arm (2) 2032) that is a surface thereof facing guide plate 2040, a control pin 2034 is provided. Control pin 2034 is provided concentrically with pin (3) 2074. Each control pin 2034 slides in a guide groove 2042 provided in guide plate 2040.

Each control pin 2034 slides in guide groove 2042 of guide plate 2040 to shift in the radial direction. The radial shift of each control pin 2034 causes intake camshaft 1120 to rotate relative to sprocket 2010.

Figure 7:
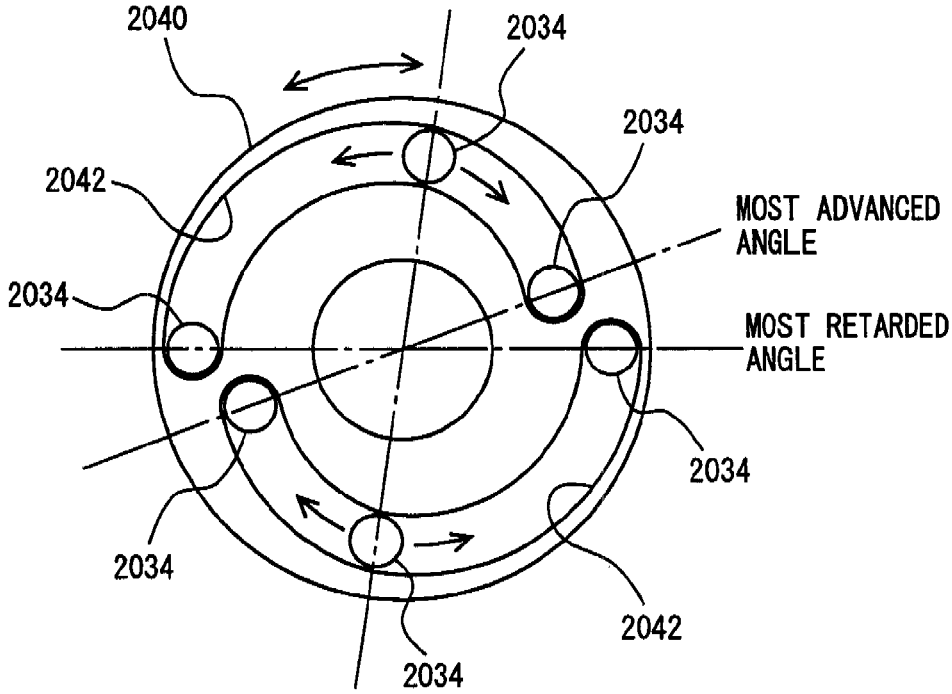
FIG. 7 is a cross section along C-C in FIG. 3.

As shown in FIG. 7 which is a cross section along C-C in FIG. 3, guide groove 2042 is formed in the spiral shape so that rotation of guide plate 2040 causes each control pin 2034 to shift in the radial direction. Here, the shape of guide groove 2042 is not limited to this.

As control pin 2034 is shifted further in the radial direction from the axial center of guide plate 2040, the phase of intake valve 1100 is retarded to a greater extent. In other words, the variation amount of the phase has a value corresponding to the operation amount of link mechanism 2030 generated by the radial shift of control pin 2034. Alternatively, the phase of intake valve 1100 may be advanced to a greater extent as control pin 2034 is shifted further in the radial direction from the axial center of guide plate 2040.

As shown in FIG. 7, when control pin 2034 abuts on an end of guide groove 2042, the operation of link mechanism 2030 is restrained. Therefore, the phase in which control pin 2034 abuts on an end of guide groove 2042 is the phase of the most retarded angle or the most advanced angle.

Referring back to FIG. 3, in guide plate 2040, a plurality of depressed portions 2044 are provided in its surface facing speed reducer 2050, for coupling guide plate 2040 and speed reducer 2050 to each other.

Speed reducer 2050 is comprised of an outer teeth gear 2052 and an inner teeth gear 2054. Outer teeth gear 2052 is fixed with respect to sprocket 2010 so that the gear rotates together with sprocket 2010.

Inner teeth gear 2054 has a plurality of protruded portions 2056 thereon that are received in depressed portions 2044 of guide plate 2040. Inner teeth gear 2054 is supported rotatably about an eccentric axis 2066 of a coupling 2062 formed eccentrically with respect to an axial center 2064 of an output shaft of electric motor 2060.

Figure 8:
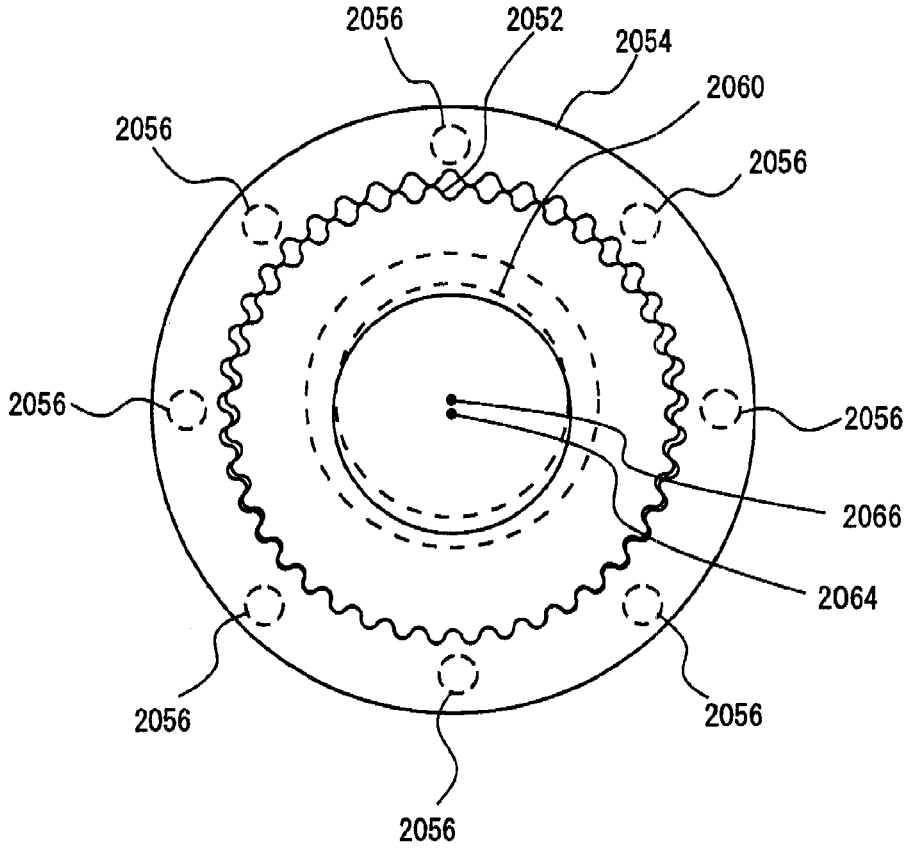
FIG. 8 is a cross section along D-D in FIG. 3.

FIG. 8 shows a cross section along D-D in FIG. 3. Inner teeth gear 2054 is provided so that a part of the teeth thereof meshes with outer teeth gear 2052. In the case where the rotational speed of the output shaft of electric motor 2060 is identical to the rotational speed of sprocket 2010, coupling 2062 and inner teeth gear 2054 rotate at the same rotational speed as that of outer teeth gear 2052 (sprocket 2010). In this case, guide plate 2040 rotates at the same rotational speed as that of sprocket 2010 and accordingly the phase of intake valve 1100 is maintained.

When electric motor 2060 causes coupling 2062 to rotate about axial center 2064 and relative to outer teeth gear 2052, accordingly inner teeth gear 2054 as a whole revolves about axial center 2064 while inner teeth gear 2054 rotates about eccentric axis 2066. The rotational motion of inner teeth gear 2054 causes guide plate 2040 to rotate relative to sprocket 2010 and thus the phase of intake valve 1100 is changed.

The phase of intake valve 1100 is changed by reduction of the rotational speed of relative rotation between the output shaft of electric motor 2060 and sprocket 2010 (operation amount of electric motor 2060) by speed reducer 2050, guide plate 2040 and link mechanism 2030. Here, the rotational speed of relative rotation between the output shaft of electric motor 2060 and sprocket 2010 may be increased to change the phase of intake valve 1100.

Figure 9:
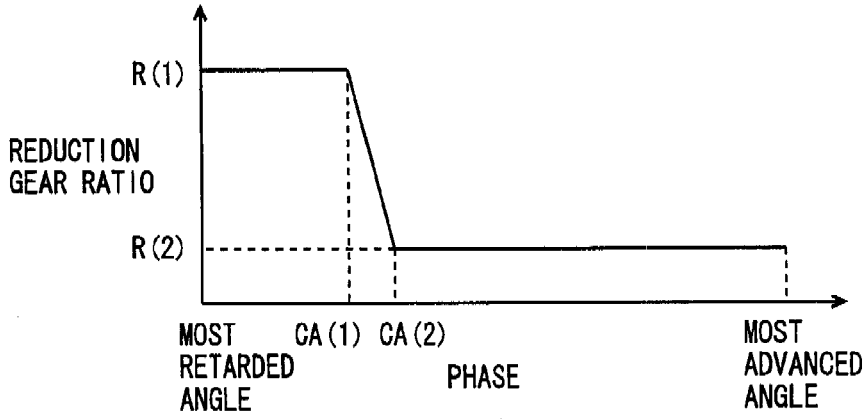
FIG. 9 shows the reduction gear ratio of the intake WT mechanism as a whole.

As shown in FIG. 9, the reduction gear ratio of intake VVT mechanism 2000 as a whole (the ratio of the rotational speed of relative rotation between the output shaft of electric motor 2060 and sprocket 2010 to the variation amount of the phase) may have a value according to the phase of intake valve 1100. In the present embodiment, as the reduction gear ratio is higher, the variation amount of the phase with respect to the rotational speed of relative rotation between the output shaft of electric motor 2060 and sprocket 2010 is smaller.

In the case where the phase of intake valve 1100 is in a first region from the most retarded angle to CA (1), the reduction gear ratio of intake VVT mechanism 2000 as a whole is R (1). In the case where the phase of intake valve 1100 is in a second region from CA (2) (CA (2) is advanced with respect to CA (1)) to the most advanced angle, the reduction gear ratio of intake VVT mechanism 2000 as a whole is R (2) (R (1)>R (2)).

In the case where the phase of intake valve 1100 is in a third region from CA (1) to CA (2), the reduction gear ratio of intake VVT mechanism 2000 as a whole changes at a predetermined rate of change ((R (2)−R (1))/(CA (2)−CA (1)).

The function of intake VVT mechanism 2000 of the variable valve timing apparatus will be described below.

Figure 10:
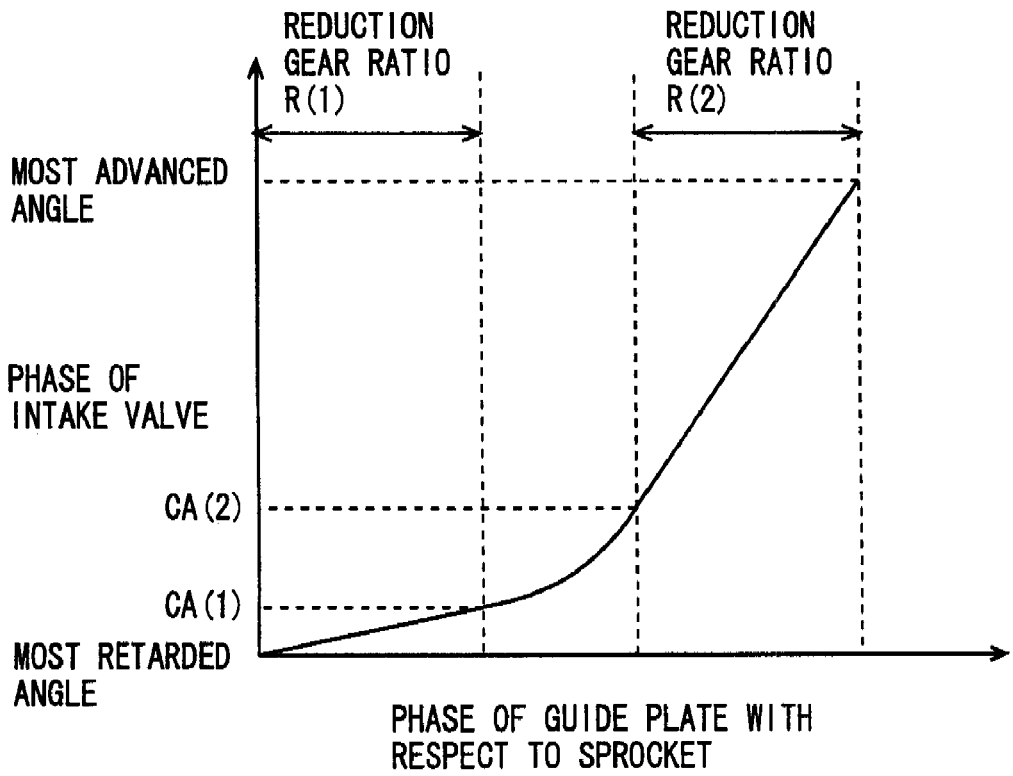
FIG. 10 shows a relation between the phase of a guide plate relative to a sprocket and the phase of the intake valve.

In the case where the phase of intake valve 1100 (intake camshaft 1120) is to be advanced, electric motor 2060 is operated to rotate guide plate 2040 relative to sprocket 2010, thereby advancing the phase of intake valve 1100 as shown in FIG. 10.

In the case where the phase of intake valve 1100 is in the first region between the most retarded angle and CA (1), the rotational speed of relative rotation between the output shaft of electric motor 2060 and sprocket 2010 is reduced at reduction gear ratio R (1) to advance the phase of intake valve 1100.

In the case where the phase of intake valve 1100 is in the second region between CA (2) and the most advanced angle, the rotational speed of relative rotation between the output shaft of electric motor 2060 and sprocket 2010 is reduced at reduction gear ratio R (2) to advance the phase of intake valve 1100.

In the case where the phase of intake valve 1100 is to be retarded, the output shaft of electric motor 2060 is rotated relative to sprocket 2010 in the direction opposite to the direction in the case where the phase thereof is to be advanced. In the case where the phase is to be retarded, similarly to the case where the phase is to be advanced, when the phase of intake valve 1100 is in the first region between the most retarded angle and CA (1), the rotational speed of relative rotation between the output shaft of electric motor 2060 and sprocket 2010 is reduced at reduction gear ratio R (1) to retard the phase. Further, when the phase of intake valve 1100 is in the second region between CA (2) and the most advanced angle, the rotational speed of relative rotation between the output shaft of electric motor 2060 and sprocket 2010 is reduced at reduction gear ratio R (2) to retard the phase.

Accordingly, as long as the direction of the relative rotation between the output shaft of electric motor 2060 and sprocket 2010 is the same, the phase of intake valve 1100 can be advanced or retarded for both of the first region between the most retarded angle and CA (1) and the second region between CA (2) and the most advanced angle. Here, for the second region between CA (2) and the most advanced angle, the phase can be more advanced or more retarded. Thus, the phase can be changed over a wide range.

Further, since the reduction gear ratio is high for the first region between the most retarded angle and CA (1), a large torque is necessary for rotating the output shaft of electric motor 2060 by a torque acting on intake camshaft 1120 as engine 1000 operates. Therefore, in the case where electric motor 2060 is stopped for example, even if electric motor 2060 generates no torque, rotation can be restrained of the output shaft of electric motor 2060 caused by the torque acting on intake camshaft 1120. Therefore, a change of the actual phase from a phase determined under control can be restrained.

In the chase where the phase of intake valve 1100 is in the third region between CA (1) and CA (2), the rotational speed of relative rotation between the output shaft of electric motor 2060 and sprocket 2010 is reduced at a reduction gear ratio that changes at a predetermined rate of change, which may result in advance or retard in phase of intake valve 1100.

Accordingly, in the case where the phase changes from the first region to the second region or from the second region to the first region, the variation amount of the phase with respect to the rotational speed of relative rotation between the output shaft of electric motor 2060 and sprocket 2010 can be increased or decreased gradually. In this way, a sudden stepwise change of the variation amount of the phase can be restrained to thereby restrain a sudden change in phase. Accordingly, the capability to control the phase can be improved.

Figure 11:
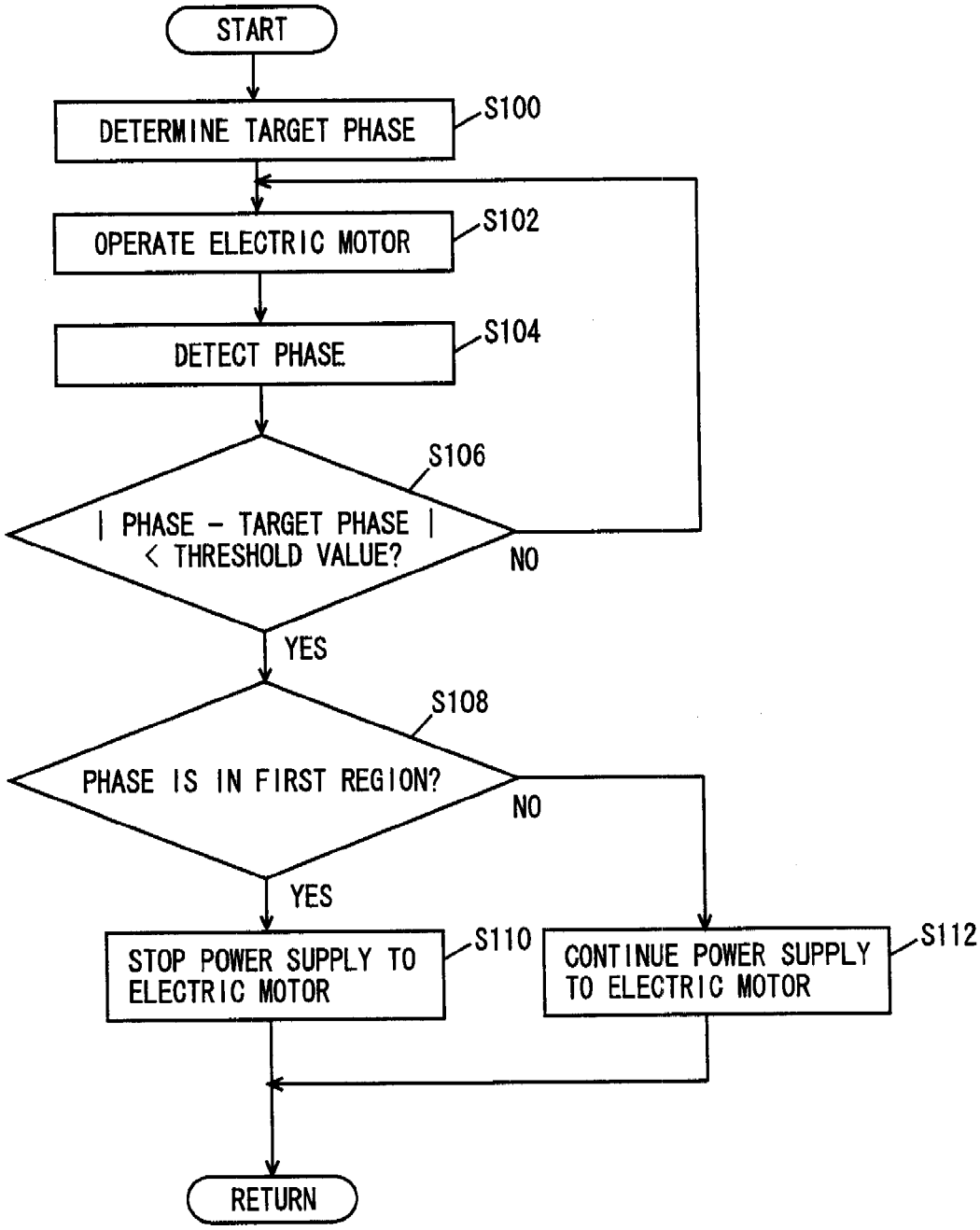
FIG. 11 is a flowchart illustrating a control structure of a program executed by an ECU in the first embodiment of the present invention.

Referring to FIG. 11, the control structure of a program executed by ECU 4000 that controls the variable valve timing apparatus in accordance with the present embodiment will be described.

At the step (abbreviated as S hereinafter) 100, ECU 4000 uses the map shown in FIG. 2 as described above to determine a target phase of intake valve 1100 based on engine speed NE and intake air quantity KL.

At S102, ECU 4000 operates electric motor 2060 so that the phase of intake valve 1100 becomes the target phase.

At S104, ECU 4000 detects the phase of intake camshaft 1120, namely the phase of intake valve 1100, based on the signal transmitted from cam position sensor 5010.

At S106, ECU 4000 determines whether or not the difference between the phase of intake valve 1100 and the target phase becomes equal to or lower than a threshold value. When the difference between the phase of intake valve 1100 and the target phase becomes equal to or lower than a threshold value (YES at S106), the process goes to S108. If not (NO at S106), the process returns to S102.

At S108, ECU 4000 determines whether or not the phase of intake valve 1100 is in the first region between the most retarded angle and CA (1). If the phase of intake valve 1100 is in the first region (YES at S108), the process goes to S110. If not (NO at S108), the process goes to S112.

At S110, ECU 4000 stops the power supply to electric motor 2060. At S112, ECU 4000 continues the power supply to electric motor 2060 so as to prevent the relative rotation between the output shaft 2060 and sprocket 2010. More specifically, in the state where the power supply to electric motor 2060 is continued, the phase variation of intake valve 1110 is stopped.

The operation of the variable valve timing apparatus in accordance with the present embodiment will now be described based on the structure and flowchart as described above.

During the operation of engine 1000, using the map shown in FIG. 2 as described above, based on engine speed NE and intake air quantity KL, the target phase of intake valve 1100 is determined (S100). Electric motor 2060 is operated so that this target phase is achieved (S102).

When the difference between the phase of intake valve 1100 and the target phase becomes equal to or lower than the threshold value (YES at S106), it is determined whether or not the phase of intake valve 1100 is in the first region between the most retarded angle and CA (1) (S108).

In the first region (YES at S108), as mentioned above, the reduction gear ratio is high. Therefore, the output shaft of electric motor 2060 is less likely to be rotated by the torque acting on intake camshaft 1120 even in the state where electric motor 2060 generates no torque. In other words, although the output shaft of electric motor 2060 is rotated (is forced to rotate) at the same rotational speed as sprocket 2010, the relative rotation between the output shaft of electric motor 2060 and sprocket 2010 is less likely to be caused and the phase of intake valve 1100 is less likely to be varied.

Then, the power supply to electric motor 2060 is stopped (S110). Accordingly, in the state where the power supply to electric motor 2060 is stopped, the phase of intake valve 1100 can be maintained. Therefore, fuel economy can ultimately be enhanced.

On the other hand, outside of the first region (NO at S108), the reduction gear ratio is not high. Therefore, in the state where electric motor 2060 generates no torque, the output shaft of electric motor 2060 is rotated relative to sprocket 2010 by the torque acting on intake camshaft 1120, so that the phase of intake valve 1100 may not be maintained. Accordingly, the power supply to electric motor 2060 is continued so as to generate such torque that does not cause relative rotation between the output shaft of electric motor 2060 and sprocket 2010 (S112).

As described above, in the variable valve timing apparatus in accordance with the present embodiment, in the case where the phase of the intake valve is in the first region from the most retarded angle to CA (1), the reduction gear ratio of the intake VVT mechanism as a whole is R (1). In the case where the phase of the intake valve is in the second region from CA (2) to the most advanced angle, the reduction gear ratio of the intake VVT mechanism as a whole is R (2) smaller than R (1). Accordingly, the phase can be varied widely in the second region. Furthermore, if the phase of the intake valve is in the first region, the phase of the intake valve is less likely to be varied even in the state where the electric motor generates no torque. Therefore, the power supply to the electric motor is stopped. As a result, fuel economy can ultimately be enhanced.

It is noted that only in the case where the phase of intake valve 1100 is a phase of a part of the first region (for example, the phase of the most retarded angle), the power supply to electric motor 2060 may be stopped to maintain the phase.

In place of or in addition to the detection of the phase of intake valve 1100 based on the signal transmitted from cam position sensor 5010, the phase of intake valve 1100 may be detected based on the rotational speed (number of rotations accumulated) of electric motor 2060.

Second Embodiment

In the following, a second embodiment of the present invention will be described. The present embodiment differs from the foregoing first embodiment in that the target phase of intake valve 1100 is not determined to be in the third region between CA (1) and CA (2). The other structure is the same as that of the foregoing first embodiment. The function is also the same. Therefore, the detailed description thereof will not be repeated here.

Figure 12:
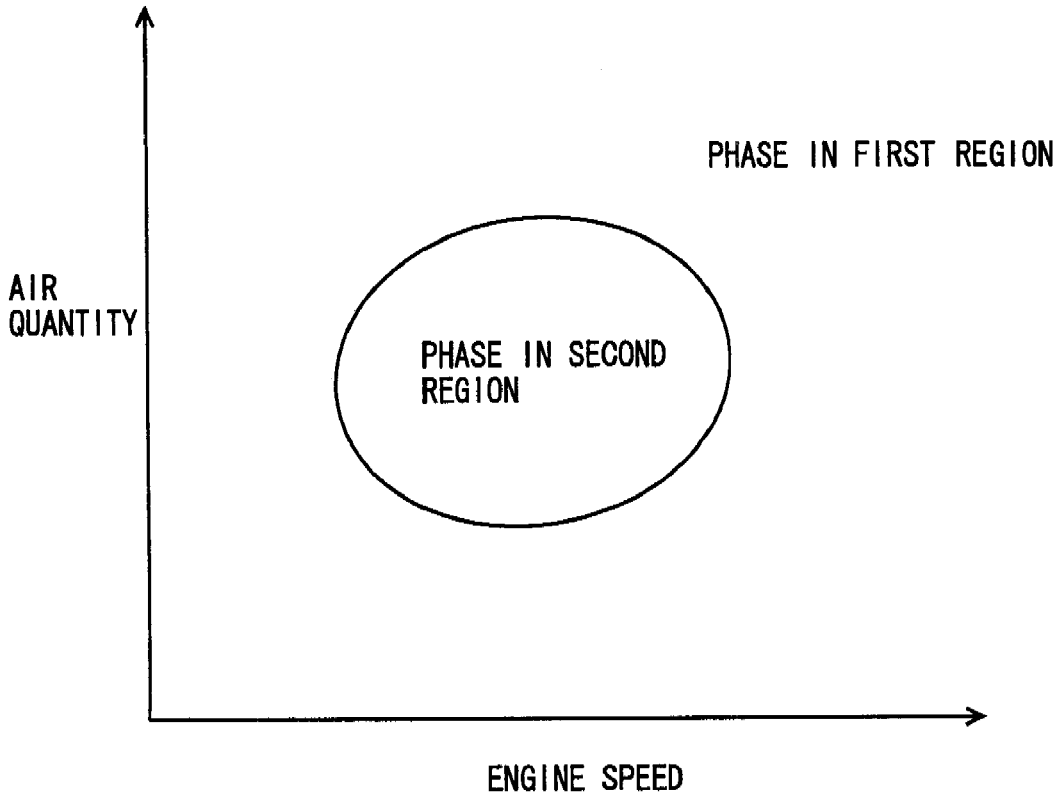
FIG. 12 shows a map defining the phase of the intake valve in a second embodiment of the present invention.

As shown in FIG. 12, in the map for use to determine the phase (target phase) of intake valve 1100, the phase in the first region between the most retarded angle and CA (1) and the phase in the second region between CA (2) and the most advanced angle are defined. On the other hand, the phase in the third region between CA (1) and CA (2) is not defined.

Thus, it can be restrained that intake VVT mechanism 2000 is controlled such that the phase falls in the third region where the reduction gear ratio varies. Therefore, it can be restrained that the phase is controlled in the region where the variation amount of the phase is hardly predicted because of the varied reduction gear ratio. As a result, deterioration in accuracy of the phase can be prevented.

Furthermore, the map shown in FIG. 12 is created such that the phase of intake valve 1100 is a phase in the first region more frequently. Therefore, the frequency of maintaining the phase can be increased by stopping the power supply to electric motor 2060. Therefore, fuel economy can be improved more.

Third Embodiment

In the following, a third embodiment of the present invention will be described. The present embodiment differs from the foregoing first embodiment in that, in the case where the phase of the intake valve is in the first region from the most retarded angle to CA (1), if engine speed NE is equal to or lower than threshold value NE (0), the power supply to electric motor 2060 is stopped to maintain the phase. The other structure is the same as that of the foregoing first embodiment. The function is also the same. Therefore, the detailed description thereof will not be repeated here.

Figure 13:
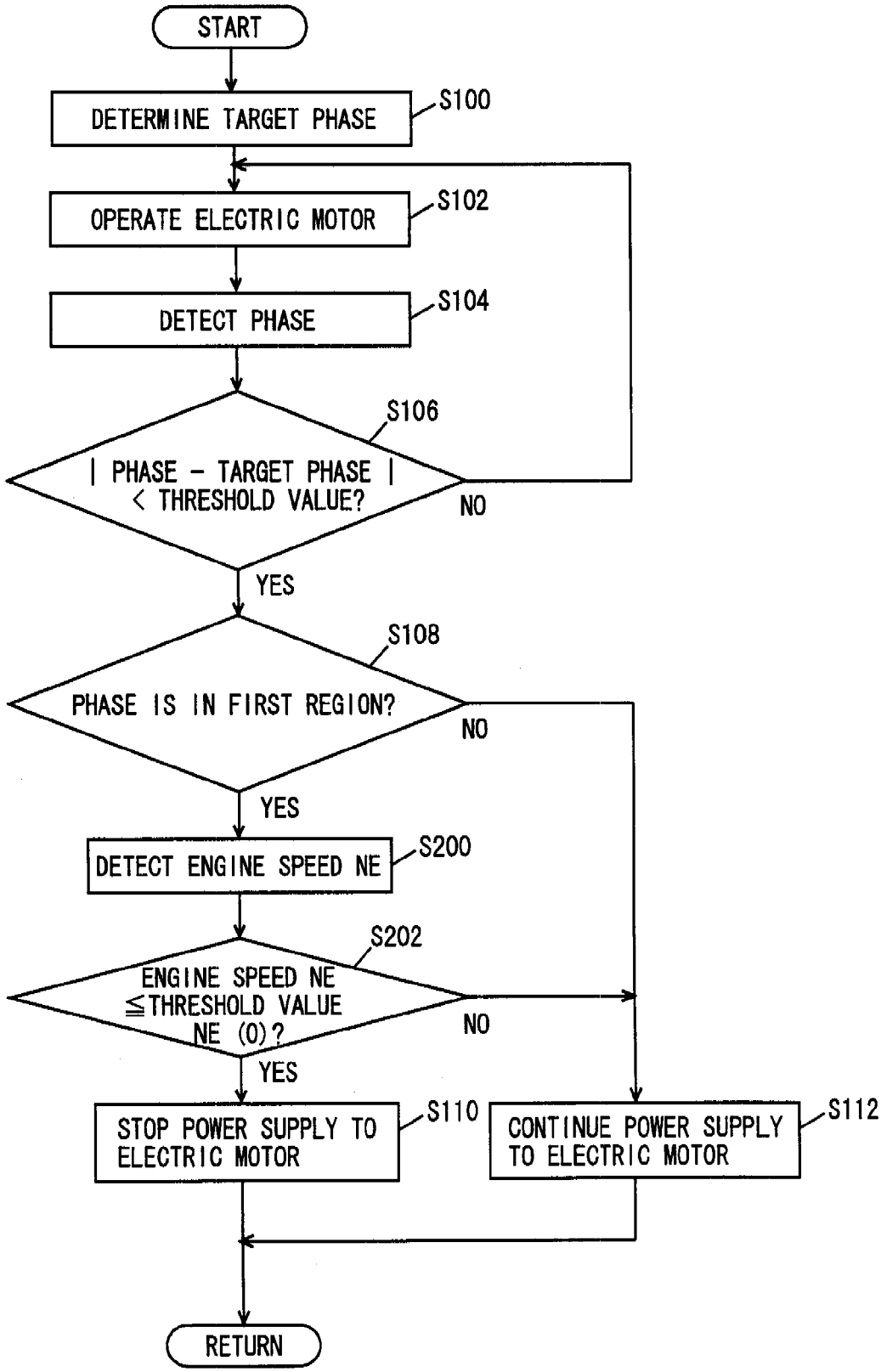
FIG. 13 is a flowchart illustrating a control structure of a program executed by the ECU in the third embodiment of the present invention.

Referring to FIG. 13, the control structure of a program executed by ECU 4000 that controls the variable valve timing apparatus in accordance with the present embodiment will be described. It is noted that the same processes as those in the foregoing first embodiment will be denoted with the same step numbers and the description thereof will not be repeated here.

At S200, ECU 4000 detects engine speed NE based on the signal transmitted from crank angle sensor 5000. At S202, ECU 4000 determines whether or not engine speed NE is equal to or lower than threshold value NE (0). If engine speed NE is equal to or lower than threshold value NE (0) (YES at S202), the process goes to S110. If not (NO at S202), the process goes to S112.

The operation of the variable valve timing apparatus in accordance with the present embodiment will be described based on the structure and flowchart as described above.

During the operation of engine 1000, using the map shown in FIG. 2 as described above, the target phase of intake valve 1100 is determined based on engine speed NE and intake air quantity KL (S100). Electric motor 2060 is operated so that this target phase is achieved (S102).

When the difference between the phase of intake valve 1100 and the target phase becomes equal to or lower than the threshold value (YES at S106), it is determined whether or not the phase of intake valve 1100 is in the first region between the most retarded angle and CA (1) (S108).

In the first region (YES at S108), the reduction gear ratio is high. Therefore, even in the state where electric motor 2060 generates no torque, the output shaft of electric motor 2060 is less likely to be rotated by the torque acting on intake camshaft 1120. In other words, although the output shaft of electric motor 2060 is rotated (is forced to rotate) at the same rotational speed as sprocket 2010, the relative rotation between the output shaft of electric motor 2060 and sprocket 2010 is less likely to be caused and the phase of intake valve 1100 is less likely to be varied.

However, if engine speed NE is high, namely if the rotational speed of intake camshaft 1120 is high, large torque may act on intake camshaft 1120. In this case, the output shaft of electric motor 2060 may be rotated by the torque acting on intake camshaft 1120.

Accordingly, engine speed NE is detected (S200), and if the detected engine speed NE is equal to or lower than threshold value NE (0) (YES at S202), the power supply to electric motor 2060 is stopped (S110).

Even if the phase of intake valve 1100 is in the first region between the most retarded angle and CA (1) (YES at S108), if engine speed NE is higher than threshold value NE (0) (NO at S202), then the power supply to electric motor 2060 is continued so as to generate such torque that does not cause the relative rotation between the output shaft of electric motor 2060 and sprocket 2010 (S112).

Thus, it can be restrained that the power supply to electric motor 2060 is stopped in the state where the output shaft of electric motor 2060 may be rotated by the torque acting on intake camshaft 1120. Therefore, the phase can be maintained accurately.

As described above, in the variable valve timing apparatus in accordance with the present embodiment, if engine speed NE is equal to or lower than threshold value NE (0), the power supply to the electric motor is stopped, and if engine speed NE is higher than threshold value NE (0), the power supply to the electric motor is continued to maintain the phase. Accordingly, in the state where the output shaft of the electric motor may be rotated by the torque acting on the intake camshaft, the power supply to the electric motor is not stopped and the power supply is continued. Therefore, the phase can be maintained accurately.

It is noted that, in the case where the phase of intake valve 1100 is a phase of a part of the first region (for example, the phase of the most retarded angle), if engine speed NE is equal to or lower than threshold value NE (0), the power supply to electric motor 2060 may be stopped to maintain the phase, and if engine speed NE is higher than threshold value NE (0), the power supply to electric motor 2060 may be continued to maintain the phase.

Fourth Embodiment

In the following, a fourth embodiment of the present invention will be described. The present embodiment differs from the foregoing first embodiment in that, in the case where the phase of the intake valve is the phase of the most retarded angle, if engine speed NE is equal to or lower than threshold value NE (0), the power supply to electric motor 2060 is stopped to maintain the phase. The other structure is the same as that of the foregoing first embodiment. The function is also the same. Therefore, the detailed description thereof will not be repeated here.

Figure 14:
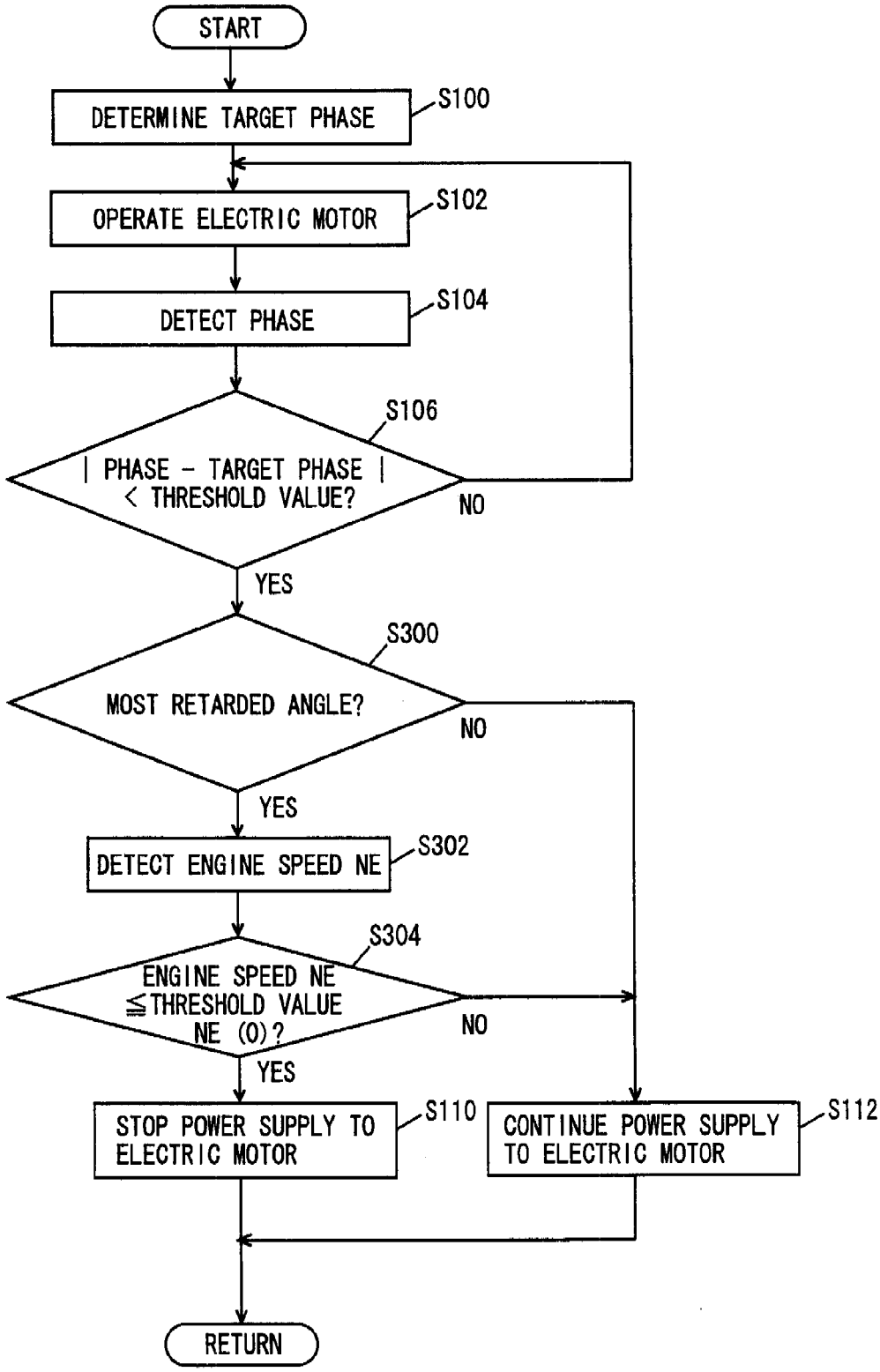
FIG. 14 is a flowchart illustrating a control structure of a program executed by the ECU in the fourth embodiment of the present invention.

Referring to FIG. 14, the control structure of a program executed by ECU 4000 that controls the variable valve timing apparatus in accordance with the present embodiment will be described. It is noted that the same processes as the processes in the foregoing first embodiment will be denoted with the same step numbers and the description thereof will not be repeated here.

At S300, ECU 4000 determines whether or not the phase of intake valve 1100 is the phase of the most retarded angle, namely the phase of the most retarded angle in the first region. If the phase of intake valve 1100 is the phase of the most retarded angle (YES at S300), the process goes to S302. If not (NO at S300), the process goes to S112.

At S302, ECU 4000 detects engine speed NE based on the signal transmitted from crank angle sensor 5000. At S304, ECU 4000 determines whether or not engine speed NE is equal to or lower than threshold value NE (0). If engine speed NE is equal to or lower than threshold value NE (0) (YES at S304), the process goes to S110. If not (NO at S304), the process goes to S112.

The operation of the variable valve timing apparatus in accordance with the present embodiment will be described based on the structure and flowchart as described above.

During the operation of engine 1000, using the map shown in FIG. 2 as described above, the target phase of intake valve 1100 is determined based on engine speed NE and intake air quantity KL (S100). Electric motor 2060 is operated so that this target phase is achieved (S102).

When the difference between the phase of intake valve 1100 and the target phase becomes equal to or lower than the threshold value (YES at S106), it is determined whether or not the phase of intake valve 1100 is the phase of the most retarded angle (S300).

The phase of the most retarded angle is a phase in the first region. As mentioned above, since the reduction gear ratio is high in the first region, even in the state where electric motor 2060 generates no torque, the output shaft of electric motor 2060 is less likely to be rotated by the torque acting on intake camshaft 1120. In other words, although the output shaft of electric motor 2060 is rotated (is forced to rotate) at the same rotational speed as sprocket 2010, the relative rotation between the output shaft of electric motor 2060 and sprocket 2010 is less likely to be caused and the phase of intake valve 1100 is less likely to be varied.

However, if engine speed NE is high, namely if the rotational speed of intake camshaft 1120 is high, large torque may act on intake camshaft 1120. In this case, the output shaft of electric motor 2060 may be rotated by the torque acting on intake camshaft 1120.

Accordingly, engine speed NE is detected (S200), and if the detected engine speed NE is equal to or lower than threshold value NE (0) (YES at S304), the power supply to electric motor 2060 is stopped (S110).

Even if the phase of intake valve 1100 is the phase of the most retarded angle (YES at S300), if engine speed NE is higher than threshold value NE (0) (NO at S304), then the power supply to electric motor 2060 is continued so as to generate such torque that does not cause relative rotation between the output shaft of electric motor 2060 and sprocket 2010 (S112). In the present embodiment, the power supply to electric motor 2060 is continued so that control pin 2034 is pressed against the end portion of guide groove 2042, thereby maintaining the phase at the phase of the most retarded angle.

Accordingly, it can be restrained that the power supply to electric motor 2060 is stopped in the state where the output shaft of electric motor 2060 may be rotated by the torque acting on intake camshaft 1120. Therefore, the phase can be maintained accurately.

As described above, in the variable valve timing apparatus in accordance with the present embodiment, if engine speed NE is equal to or lower than threshold value NE (0), the power supply to the electric motor is stopped, and if engine speed NE is higher than threshold value NE (0), the power supply to the electric motor is continued to maintain the phase at a phase of the most retarded angle. Accordingly, in the state where the output shaft of the electric motor may be rotated by the torque acting on the intake camshaft, the power supply to the electric motor is not stopped and the power supply can be continued. Therefore, the phase can be maintained accurately.

It should be noted that the embodiments disclosed herein should be understood as being illustrative rather than limitative in all respects. The scope of the present invention is indicated by the appended claims rather than by the foregoing description and all changes which come within the meaning and range of equivalency of the claims are therefore intended to be embraced therein.

The invention claimed is:

1. A variable valve timing apparatus changing an opening/closing timing of at least any one of an intake valve and an exhaust valve, comprising:

an actuator operating said variable valve timing apparatus;

a change mechanism changing said opening/closing timing at a first variation amount with respect to an operation amount of said actuator in a case where said opening/closing timing is in a first region, and changing said opening/closing timing at a second variation amount larger than said first variation amount with respect to an operation amount of said actuator in a case where said opening/closing timing is in a second region different from said first region; and an operation unit, wherein said operation unit controls said opening/closing timing by controlling power supply to said actuator, and controls said opening/closing timing such that said opening/closing timing is maintained by stopping power supply to said actuator, in a case where said opening/closing timing is in said first region.

2. The variable valve timing apparatus according to claim 1, wherein said change mechanism changes said opening/closing timing according to an operation amount of said actuator such that a ratio between an operation amount of said actuator and a variation amount of said opening/closing timing is varied, in a case where said opening/closing timing is in a third region different from said first region and said second region, in addition to changing said opening/closing timing at said first variation amount with respect to an operation amount of said actuator, in a case where said opening/closing timing is in said first region, and changing said opening/closing timing at said second variation amount with respect to an operation amount of said actuator, in a case where said opening/closing timing is in said second region, and said operation unit sets a target timing of said opening/closing timing in a region other than said third region, among said first region, said second region and said third region, and controls said opening/closing timing such that said opening/closing timing becomes said target timing.

3. The variable valve timing apparatus according to claim 1, wherein said first region is a region that is retarded with respect to said second region.

4. The variable valve timing apparatus according to claim 1, wherein said variable valve timing apparatus changes said opening/closing timing by rotating a camshaft coupled to an output shaft of an internal combustion engine, and in a case where said opening/closing timing is in said first region, if a rotational speed of said internal combustion engine is lower than a predetermined rotational speed, said operation unit controls said opening/closing timing such that said opening/closing timing is maintained by stopping power supply to said actuator, and if a rotational speed of said internal combustion engine is higher than said predetermined rotational speed, said operation unit controls said opening/closing timing such that said opening/closing timing is maintained by providing power supply to said actuator.

5. The variable valve timing apparatus according to claim 1, wherein said variable valve timing apparatus changes said opening/closing timing by rotating a camshaft coupled to an output shaft of an internal combustion engine, and in a case where said opening/closing timing is a most retarded timing in said first region, if a rotational speed of said internal combustion engine is lower than a predetermined rotational speed, said operation unit controls said opening/closing timing such that said opening/closing timing is maintained by stopping power supply to said actuator, and if a rotational speed of said internal combustion engine is higher than said predetermined rotational speed, said operation unit controls said opening/closing timing such that said opening/closing timing is maintained by providing power supply to said actuator.

6. A control method for a variable valve timing apparatus changing an opening/closing timing of at least any one of an intake valve and an exhaust valve, said variable valve timing apparatus including an actuator operating said variable valve timing apparatus, and a change mechanism changing said opening/closing timing at a first variation amount with respect to an operation amount of said actuator in a case where said opening/closing timing is in a first region, and changing said opening/closing timing at a second variation amount larger than said first variation amount with respect to an operation amount of said actuator in a case where said opening/closing timing is in a second region different from said first region, said control method comprising the step of controlling said opening/closing timing by controlling power supply to said actuator, said step of controlling said opening/closing timing including the step of controlling said opening/closing timing such that said opening/closing timing is maintained by stopping power supply to said actuator, in a case where said opening/closing timing is in said first region.

7. The control method for a variable valve timing apparatus according to claim 6, wherein said change mechanism changes said opening/closing timing according to an operation amount of said actuator such that a ratio between an operation amount of said actuator and a variation amount of said opening/closing timing is varied, in a case where said opening/closing timing is in a third region different from said first region and said second region, in addition to changing said opening/closing timing at said first variation amount with respect to an operation amount of said actuator, in a case where said opening/closing timing is in said first region, and changing said opening/closing timing at said second variation amount with respect to an operation amount of said actuator, in a case where said opening/closing timing is in said second region, said control method further comprises the step of setting a target timing of said opening/closing timing in a region other than said third region, among said first region, said second region and said third region, and said step of controlling said opening/closing timing includes the step of controlling said opening/closing timing such that said opening/closing timing becomes said target timing.

8. The control method for a variable valve timing apparatus according to claim 6, wherein said first region is a region that is retarded with respect to said second region.

9. The control method for a variable valve timing apparatus according to claim 6, wherein said variable valve timing apparatus changes said opening/closing timing by rotating a camshaft coupled to an output shaft of an internal combustion engine, and in a case where said opening/closing timing is in said first region, said step of controlling said opening/closing timing includes the step of controlling said opening/closing timing such that said opening/closing timing is maintained by stopping power supply to said actuator, if a rotational speed of said internal combustion engine is lower than a predetermined rotational speed, and controlling said opening/closing timing such that said opening/closing timing is maintained by providing power supply to said actuator, if a rotational speed of said internal combustion engine is higher than said predetermined rotational speed.

10. The control method for a variable valve timing apparatus according to claim 6, wherein said variable valve timing apparatus changes said opening/closing timing by rotating a camshaft coupled to an output shaft of an internal combustion engine, and in a case where said opening/closing timing is a most retarded timing in said first region, said step of controlling said opening/closing timing includes the step of controlling said opening/closing timing such that said opening/closing timing is maintained by stopping power supply to said actuator, if a rotational speed of said internal combustion engine is lower than a predetermined rotational speed, and controlling said opening/ closing timing such that said opening/closing timing is maintained by providing power supply to said actuator, if a rotational speed of said internal combustion engine is higher than said predetermined rotational speed.

11. A variable valve timing apparatus changing an opening/closing timing of at least any one of an intake valve and an exhaust valve, comprising:

an actuator operating said variable valve timing apparatus;

a change mechanism changing said opening/closing timing at a first variation amount with respect to an operation amount of said actuator in a case where said opening/closing timing is in a first region, and changing said opening/closing timing at a second variation amount larger than said first variation amount with respect to an operation amount of said actuator in a case where said opening/closing timing is in a second region different from said first region; and control means for controlling said opening/closing timing by controlling power supply to said actuator, said control means including means for controlling said opening/closing timing such that said opening/closing timing is maintained by stopping power supply to said actuator, in a case where said opening/closing timing is in said first region.

12. The variable valve timing apparatus according to claim 11, wherein said change mechanism changes said opening/closing timing according to an operation amount of said actuator such that a ratio between an operation amount of said actuator and a variation amount of said opening/closing timing is varied, in a case where said opening/closing timing is in a third region different from said first region and said second region, in addition to changing said opening/closing timing at said first variation amount with respect to an operation amount of said actuator, in a case where said opening/closing timing is in said first region, and changing said opening/closing timing at said second variation amount with respect to an operation amount of said actuator, in a case where said opening/closing timing is in said second region, said variable valve timing apparatus further comprises setting means for setting a target timing of said opening/closing timing in a region other than said third region, among said first region, said second region and said third region, and said control means includes means for controlling said opening/closing timing such that said opening/closing timing becomes said target timing.

13. The variable valve timing apparatus according to claim 11, wherein said first region is a region that is retarded with respect to said second region.

14. The variable valve timing apparatus according to claim 11, wherein said variable valve timing apparatus changes said opening/closing timing by rotating a camshaft coupled to an output shaft of an internal combustion engine, and in a case where said opening/closing timing is in said first region, said control means further includes means for controlling said opening/closing timing such that said opening/closing timing is maintained by stopping power supply to said actuator, if a rotational speed of said internal combustion engine is lower than a predetermined rotational speed, and controlling said opening/closing timing such that said opening/closing timing is maintained by providing power supply to said actuator, if a rotational speed of said internal combustion engine is higher than said predetermined rotational speed.

15. The variable valve timing apparatus according to claim 11, wherein said variable valve timing apparatus changes said opening/closing timing by rotating a camshaft coupled to an output shaft of an internal combustion engine, and in a case where said opening/closing timing is a most retarded timing in said first region, said control means includes means for controlling said opening/closing timing such that said opening/closing timing is maintained by stopping power supply to said actuator, if a rotational speed of said internal combustion engine is lower than a predetermined rotational speed, and controlling said opening/closing timing such that said opening/closing timing is maintained by providing power supply to said actuator, if a rotational speed of said internal combustion engine is higher than said predetermined rotational speed.

16. A variable valve timing apparatus changing an opening/closing timing of at least any one of an intake valve and an exhaust valve, comprising:

an actuator operating said variable valve timing apparatus;

a change mechanism changing said opening/closing timing at a first variation amount with respect to an operation amount of said actuator in a case where said opening/closing timing is in a first region, and changing said opening/closing timing at a second variation amount larger than said first variation amount with respect to an operation amount of said actuator in a case where said opening/closing timing is in a second region different from said first region; and an operation unit, wherein said operation unit controls said opening/closing timing by controlling power supply to said actuator, and controls said opening/closing timing such that said opening/closing timing is maintained by stopping power supply to said actuator, only in a case where said opening/closing timing is in said first region.

* * * * *